US011270858B2

(12) United States Patent
Nakatani et al.

(10) Patent No.: US 11,270,858 B2
(45) Date of Patent: Mar. 8, 2022

(54) ELECTRICAL CIRCUIT BREAKER

(71) Applicant: PACIFIC ENGINEERING CORPORATION, Ogaki (JP)

(72) Inventors: Takenao Nakatani, Ogaki (JP); Yusuke Kondo, Ogaki (JP)

(73) Assignee: Pacific Engineering Corporation, Ogaki (JP)

( * ) Notice: Subject to any disclaimer, the term of this patent is extended or adjusted under 35 U.S.C. 154(b) by 0 days.

(21) Appl. No.: 17/052,115

(22) PCT Filed: Apr. 19, 2019

(86) PCT No.: PCT/JP2019/016750
§ 371 (c)(1),
(2) Date: Oct. 30, 2020

(87) PCT Pub. No.: WO2019/235081
PCT Pub. Date: Dec. 12, 2019

(65) Prior Publication Data

US 2021/0233728 A1 Jul. 29, 2021

(30) Foreign Application Priority Data

Jun. 4, 2018 (JP) ..... JP2018-106640

(51) Int. Cl.
*H01H 9/30* (2006.01)
*H01H 39/00* (2006.01)
*H01H 73/18* (2006.01)

(52) U.S. Cl.
CPC ..... *H01H 39/006* (2013.01); *H01H 9/30* (2013.01); *H01H 73/18* (2013.01)

(58) Field of Classification Search
CPC ..... H01H 39/006; H01H 39/002; H01H 2039/008; H01H 9/30; H01H 9/041;
(Continued)

(56) References Cited

U.S. PATENT DOCUMENTS 5,828,026 A * 10/1998 Bruhl ..... H01H 33/76 218/150
7,222,561 B2 * 5/2007 Brede ..... B23D 15/145 200/61.08

(Continued)

FOREIGN PATENT DOCUMENTS

JP 57-19929 A 2/1982
JP 04-292828 A 10/1992

(Continued)

OTHER PUBLICATIONS

Translation of JP2013239412 (Original document published Nov. 28, 2013). (Year: 2013).*

(Continued)

*Primary Examiner* — William A Bolton
(74) *Attorney, Agent, or Firm* — FisherBroyles LLP; Kevin D. Jablonski

(57) ABSTRACT

An electric circuit breaker that prevents damage due to increased internal pressure after an electric circuit is cut off and prevents an arc from leaking to the outside. Such a circuit breaker includes a housing, a cut portion that is arranged in the housing and forms a part of an electric circuit, a cutting member that cuts the cut portion, and a power source arranged on a first end portion side of the housing, the electric circuit breaker including a moving body including the cutting member, in which the housing includes a cylindrical portion capable of moving the moving body between the first end portion and a second end portion on a side opposite to the first end portion, in which the moving body is configured such that the cutting member provided in the moving body cuts a separation piece of the cut portion.

3 Claims, 10 Drawing Sheets

(58) Field of Classification Search
CPC ..... H01H 73/18; H01H 73/36; H01H 73/64; H01H 73/60; H01H 35/14
USPC ..... 200/61.08, 61.09; 337/401
See application file for complete search history.

(56) References Cited

U.S. PATENT DOCUMENTS

| | | | | |
|---|---|---|---|---|
| 7,498,531 | B2 * | 3/2009 | Knauss | H01H 39/006 200/61.08 |
| 7,511,600 | B2 * | 3/2009 | Von Behr | H01H 39/006 200/61.08 |
| 8,432,246 | B2 * | 4/2013 | Suzuki | H01H 39/006 337/157 |
| 9,704,641 | B2 * | 7/2017 | Park | H01F 27/33 |
| 9,905,383 | B2 * | 2/2018 | Hori | B60L 3/0007 |
| 2014/0061161 | A1 * | 3/2014 | Nakamura | H01H 33/74 218/26 |

FOREIGN PATENT DOCUMENTS

| | | | |
|---|---|---|---|
| JP | 08-279327 | A | 10/1996 |
| JP | 2013-239412 | A | 11/2013 |
| WO | 2015117998 | A2 | 8/2015 |

OTHER PUBLICATIONS

International Search Report & Written Opinion dated Jul. 23, 2019; PCT Application No. PCT/JP2019/016750 filed Apr. 19, 2019; pp. 1-8.

* cited by examiner

ELECTRICAL CIRCUIT BREAKER

CLAIM TO PRIORITY APPLICATIONS

The present application is a National Stage Application of PCT Application serial No. PCT/JP2019/016750, filed Apr. 19, 2019, which claims priority filing to Japanese Patent Application No. 2018-106640 filed Jun. 4, 2018, all of which are incorporated herein by reference in their entireties.

BACKGROUND

The subject matter of the present disclosure relates to an electric circuit breaker that can be used mainly for electric circuits of automobiles and the like. Conventionally, an electric circuit breaker has been used to protect an electric circuit mounted on an automobile or the like and various electric components connected to the electric circuit. More specifically, when an abnormality occurs in the electric circuit, the electric circuit breaker physically cuts off the electric circuit by cutting a part of the electric circuit.

There are various types of the electric circuit breaker, and for example, in an electric circuit breaker 700 of a conventional device shown in FIG. 10, a dielectric 710 forming a part of an electric circuit is inserted through cutting chambers 721 in a housing 720 and accommodated therein, and the dielectric 710 is physically cut by a punch 730. The punch 730 punches the dielectric 710 in the cylindrical cutting chambers 721 so as to cross the dielectric 710, and the punched conductors 710 are in a separated state. Further, after the dielectric 710 is punched out, an arc is generated between the conductors 710 on both sides that remain in the housing, and the conductors 710 heated to high temperature by the arc are melted to generate gas. If the internal pressure of the cutting chambers 721 increases due to the gas, the cutting chambers 721 may be damaged.

Therefore, the electric circuit breaker 700 is provided with ventilation portions 740 that can release the pressure to the outside when the internal pressure increases due to the gas. However, when the internal pressure is released, the arc may leak from the ventilation portions 740 to the outside, and there is a problem that the leaked arc damages other external devices.

Therefore, in view of the above problems, the present disclosure provides an electric circuit breaker that prevents damage due to increased internal pressure after an electric circuit is cut off and prevents an arc from leaking to the outside.

BRIEF DESCRIPTION OF THE DRAWINGS

The subject matter presented herein will now be described, by way of example, with reference to the accompanying drawings, in which.

| | |
|---|---|
| 300 | housing |
| 310 | cylindrical portion |
| 320 | first end portion |
| 330 | second end portion |
| 400 | cut portion |
| 420 | separation piece |
| 430 | main body portion |
| 500 | moving body |
| 511 | cutting member |
| P | power source |
| X1 | first arc extinguishing space |
| M | arc extinguishing material |

DETAILED DESCRIPTION

Each of embodiments of the present disclosure will be described below with reference to the drawings. The shape, material, etc. of each member of an electric circuit breaker according to the embodiments described below are examples, and the present disclosure is not limited to these.

First Embodiment

Figure 1A:
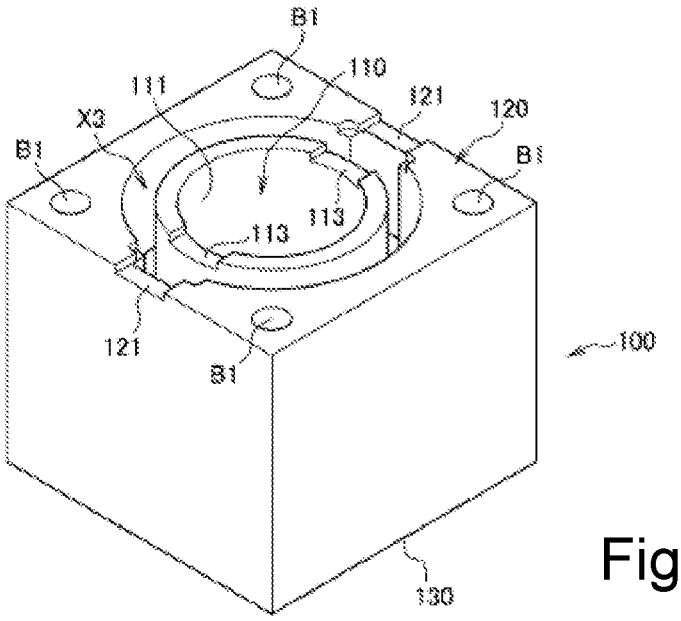
FIG. 1(*a*) is an overall perspective view of a lower housing that constitutes a housing of an electric circuit breaker according to a first embodiment of the present disclosure, and FIG. 1(*b*) is a plan view of the lower housing.
Figure 1B:
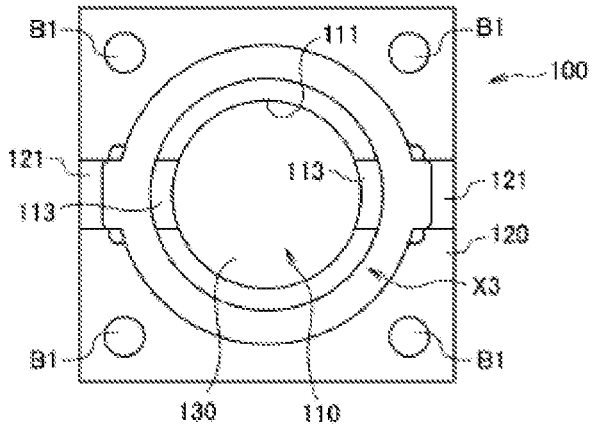

First, FIG. 1 shows a lower housing 100 that constitutes a housing 300 according to a first embodiment of the present disclosure. FIG. 1(*a*) is an overall perspective view of the lower housing 100, and FIG. 1(*b*) is a plan view of the lower housing 100. The lower housing 100 is a substantially quadrangular prism body made of synthetic resin, and includes a cylindrical lower cylindrical portion 110, and an outer arc extinguishing space X3 formed in an annular shape around the lower cylindrical portion 110. The lower cylindrical portion 110 extends from an upper surface 120 of the lower housing 100 toward a lower surface 130, and is configured to be able to accommodate a moving body 500 described later. In addition, an inner surface 111 of the lower cylindrical portion 110 is a smooth curved surface so that the moving body 500 can slide therein in the vertical direction. Further, at a part of the upper end of the lower cylindrical portion 110, mounting portions 113 that are recessed according to the shapes of main body portions 430 are provided so that the main body portions 430 of a cut portion 400 described later can be mounted. The mounting portions 113 are arranged so as to face each other on both sides of the lower cylindrical portion 110, and the mounting portions 113 support the linearly extending cut portion 400 on both sides.

The outer arc extinguishing space X3 has the shape of a groove extending from the upper surface 120 of the lower housing 100 toward the lower surface 130, and surrounds the outer side of the lower cylindrical portion 110 in an annular shape. The outer arc extinguishing space X3 is configured to be able to accommodate an arc extinguishing material described later. The outer arc extinguishing space X3 is formed in an annular shape so as to surround the periphery of the lower cylindrical portion 110, but is not limited to this, and, for example, the outer arc extinguishing space X3 may be partially formed in only portions adjacent to the mounting portions 113 of the lower cylindrical portion 110. As will be described later, an arc is generated from the end portion 431 of the main body portion 430, which is a boundary with a separation piece 420 of the cut portion 400 as a starting point. Thus, if the outer arc extinguishing space X3 is provided in the portions adjacent to the mounting portions 113 in which the maim body portions 430 are accommodated, arc extinguishing materials in the outer arc extinguishing space X3 can extinguish the arc.

Further, at the upper surface 120 of the lower housing 100, mounting portions 121 that are recessed according to the shapes of the main body portions 430 are provided so that the main body portions 430 of the cut portion 400 described later can be mounted. The mounting portions 121 are arranged so as to face each other on both sides of the upper surface 120, and are linearly aligned with the mounting portions 113. Therefore, the mounting portions 121 can support the linearly extending cut portion 400 on both sides. Further, connecting holes B1 are formed at four corners of the upper surface 120 of the lower housing 100, and the connecting holes B1 are arranged so as to vertically match connecting holes B2 of an upper housing 200 described later.

Figure 2A:
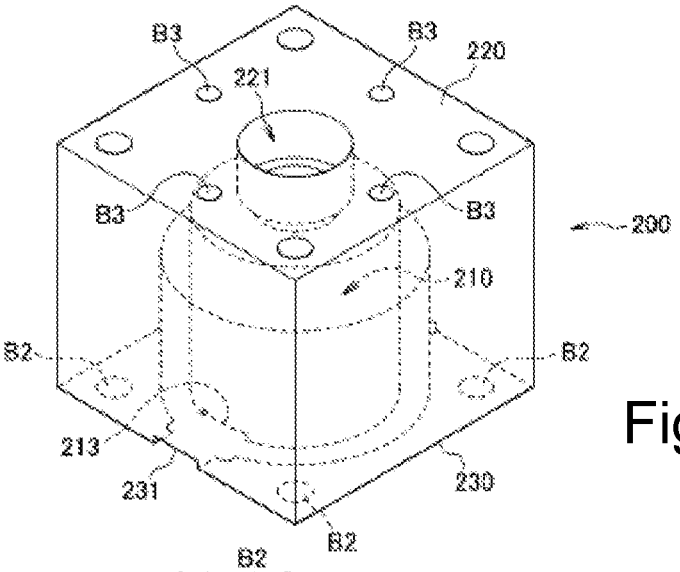
FIG. 2(*a*) is a perspective view of an upper housing that constitutes the housing of the electric circuit breaker according to the first embodiment of the present disclosure as seen from the upper side, FIG. 2(*b*) is a perspective view of the upper housing as seen from the lower side, and FIG. 2(*c*) is a bottom view of the upper housing.
Figure 2B:
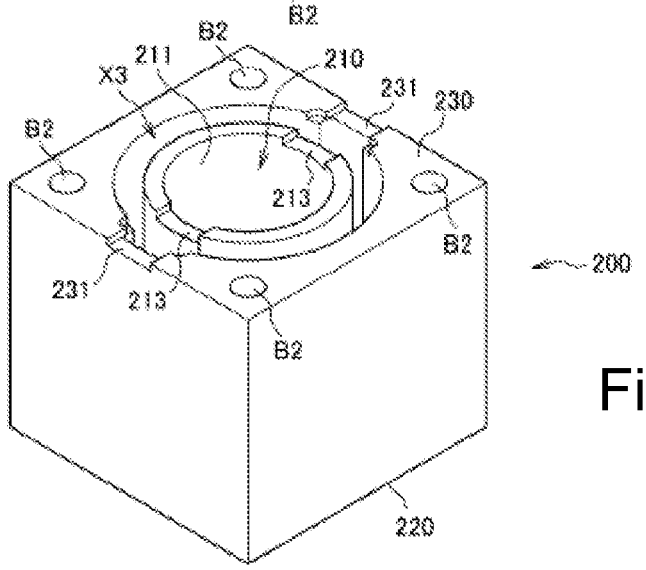
Figure 2C:
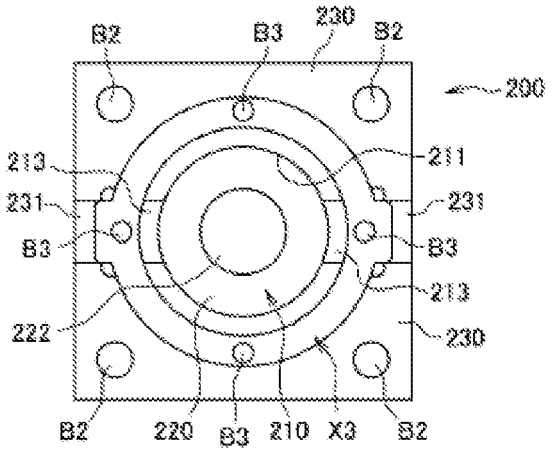

Next, FIG. 2 shows the upper housing 200 that constitutes the housing 300 according to the first embodiment of the present disclosure. FIG. 2(*a*) is a perspective view of the upper housing 200 seen from an upper surface 220 side, FIG. 2(*b*) is a perspective view of the upper housing 200 seen from a lower surface 230 side, and FIG. 2(*c*) is a bottom view of the upper housing 200.

The upper housing 200 is a substantially quadrangular prism body made of synthetic resin and forms a pair with the lower housing 100 shown in FIG. 1. Then, the upper housing 200 includes a cylindrical upper cylindrical portion 210 and an outer arc extinguishing space X3 formed in an annular shape around the upper cylindrical portion 210. The upper cylindrical portion 210 extends from the lower surface 230 of the upper housing 200 toward the upper surface 220, and is configured to be able to accommodate the moving body 500 described later. In addition, an inner surface 211 of the upper cylindrical portion 210 is a smooth curved surface so that the moving body 500 can slide therein in the vertical direction. As will be described later, the upper cylindrical portion 210 is arranged with the lower cylindrical portion 110 of the lower housing 100 in a vertical relationship to form a linearly extending cylindrical portion 310, and the inner diameter of the upper cylindrical portion 210 matches the inner diameter of the lower cylindrical portion 110. Therefore, the moving body 500 can smoothly move up and down in the cylindrical portion 310.

Further, at a part of the end portion of the upper cylindrical portion 210, mounting portions 213 that are recessed according to the shapes of the main body portions 430 of the cut portion 400 described later are provided. The mounting portions 213 are arranged so as to face each other on both sides of the upper cylindrical portion 210, and are arranged at positions corresponding to the mounting portions 113 of the lower housing 100. Therefore, the mounting portions 213 are fitted from above onto the main body portions 430 of the cut portion 400 placed on the mounting portions 113 of the lower housing 100.

The outer arc extinguishing space X3 has the shape of a groove extending from the lower surface 230 of the upper housing 200 toward the upper surface 220, and surrounds the outer side of the upper cylindrical portion 210 in an annular shape. The outer arc extinguishing space X3 is configured to be able to accommodate the arc extinguishing material. The outer arc extinguishing space X3 of the upper housing 200 is arranged at a position corresponding to the outer arc extinguishing space X3 of the lower housing 100. When the lower housing 100 and the upper housing 200 are connected and fixed, the outer arc extinguishing space X3 of the lower housing 100 and the outer arc extinguishing space X3 of the upper housing 200 communicate with each other.

In addition, the lower surface 230 of the upper housing 200 includes mounting portions 231 that are recessed according to the shapes of the main body portions 430 of the cut portion 400 described later. The mounting portions 231 are arranged so as to face each other on both sides of the lower surface 230, and are linearly aligned with the mounting portions 213. Further, the mounting portions 231 are arranged at positions corresponding to the mounting portions 121 of the lower housing 100. Therefore, the mounting portions 231 are fitted from above onto the main body portions 430 of the cut portion 400 placed on the mounting portions 121 of the lower housing 100.

Further, at a part of the upper surface 220 of the upper housing 200, a power source accommodating portion 221 for accommodating a power source P is formed. A communication hole 222 that communicates with the upper surface of the upper cylindrical portion 210 is formed on the bottom surface side of the power source accommodating portion 221. As will be described later in detail, power such as air pressure generated from the power source P accommodated in the power source accommodating portion 221 is transmitted to the inside of the upper cylindrical portion 210 through the communication hole 222, and moves the moving body 500 inside the upper cylindrical portion 210. Furthermore, through holes B3 are formed in the upper surface 220, and these through holes B3 communicate with the outer arc extinguishing space X3 inside the upper housing 200. Therefore, after the housing 300 is assembled, the arc extinguishing material can be flowed into the outer arc extinguishing spaces X3 from the outside through the through holes B3. The lower housing 100 and the upper housing 200 are substantially rectangular prism bodies made of synthetic resin, but are not limited to this, and other materials may be used to form any shape as long as they have high insulation and strength that can withstand use.

Figure 3A:
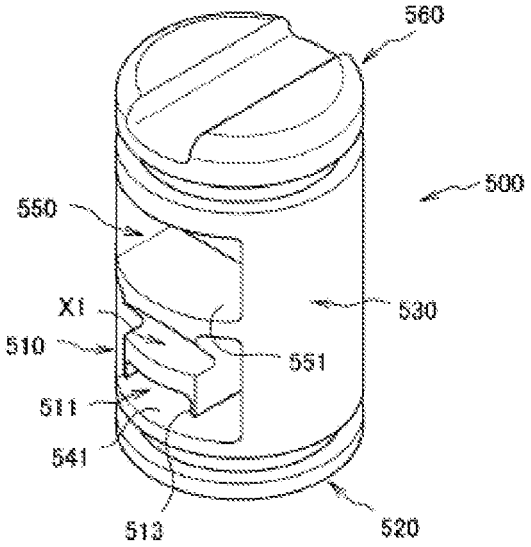
FIG. 3(*a*) is a perspective view of a moving body of the electric circuit breaker according to the first embodiment of the present disclosure, FIG. 3(*b*) is a front view of the moving body, and FIG. 3(*c*) is a side view of the moving body.
Figure 3B:
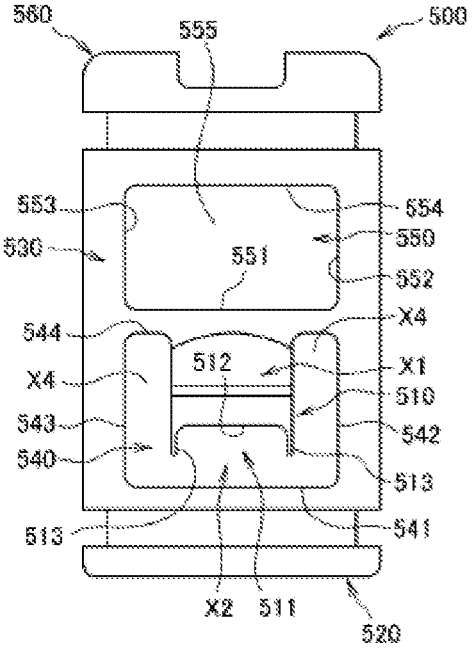
Figure 3C:
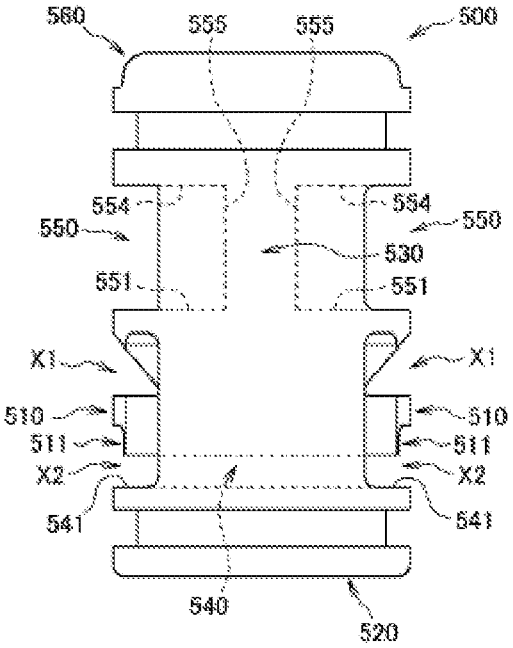

Next, FIG. 3 shows the moving body 500 according to the first embodiment of the present disclosure. FIG. 3(*a*) is a perspective view of the moving body 500, FIG. 3(*b*) is a front view of the moving body 500, and FIG. 3(*c*) is a side view of the moving body 500. The moving body 500 is a substantially columnar body made of synthetic resin and having an upper surface 560 and a lower surface 520. The outer diameter of the moving body 500 is equal to or smaller than the inner diameter of the cylindrical portion 310, and an outer surface 530 of the moving body 500 is a smooth surface corresponding to the inner surface shape of the cylindrical portion 310, so that the moving body 500 can slide the inside of the cylindrical portion 310 smoothly without gaps.

Further, on the lower surface 520 side of the moving body 500, there is provided a penetrating portion 540 which penetrates the moving body 500 from one part of the outer surface 530 to another part of the outer surface 530 on the opposite side, that is, from the front surface to the back surface of the moving body 500, and the penetrating portion 540 is surrounded by a lower wall 541, a side wall 542, a side wall 543, and an upper wall 544. Furthermore, inside the penetrating portion 540, protruding portions 510 protrude from the upper wall 544 toward the lower wall 541. First arc extinguishing spaces X1 that are recessed inward from the outer surface 530 are formed on the root sides of the protruding portions 510. A space between a cutting member 511 of the penetrating portion 540 and the lower wall 541 is larger than the cut portion 400 so that the separation piece 420 and the main body portions 430 of the cut portion 400 can be inserted, as will be described later.

Further, the cutting member 511 is formed on the tip sides of the protruding portion 510. As shown in FIG. 3(*b*), the cutting member 511 has a substantially U-shaped vertical cross section, and has an abutment surface 512 that comes into abutment against the surface of the separation piece 420 of the cut portion 400, and holding surfaces 513 that protrude from both sides of the abutment surface 512 and are configured to sandwich side surfaces 423 of the separation piece 420.

Further, the first arc extinguishing spaces X1 are arranged so as to be adjacent to the cutting member 511 on the side opposite to the separation piece 420 across the cutting members 511, and have a shape recessed inward from the outer surface 530 of the moving body 500. An arc extinguishing material can be optionally accommodated in the first arc extinguishing space X1. Further, an arc extinguishing material can be optionally accommodated in a second arc extinguishing space X2 between the cutting member 511 and the lower wall 541. Similarly, an arc extinguishing material can be optionally accommodated in a fourth arc extinguishing space X4 between the protruding portion 510 and each of the side wall 542 and the side wall 543. Therefore, the periphery of the separation piece 420 of the cut portion 400 arranged so as to come into abutment against the cutting member 511 can be surrounded by the arc extinguishing material.

Further, insulating spaces 550 that are recessed inward from the outer surface 530 are formed on the upper surface 560 side of the moving body 500. The insulating spaces 550 are formed at opposite positions on the outer surface 530. The insulating spaces 550 are each surrounded by a lower wall 551, a side wall 552, a side wall 553, an upper wall 554, and a rear wall 555. As shown in FIG. 3(*c*), the insulating spaces 550 arranged so as to face each other are shielded from each other by the rear wall 555, and are spaces insulated from each other. An arc extinguishing material is not accommodated in the insulating spaces 550, and an arc is confined and shielded as will be described later. Further, the insulating spaces 550 and the penetrating portion 540 are shielded from each other by the lower walls 551 and the upper walls 544, and are independent spaces that are insulated from each other. Similarly, the insulating spaces 550 and the first arc extinguishing spaces X1 are also shielded from each other by the lower walls 551 and the upper walls 544, and are independent spaces insulated from each other.

Note that the moving body 500 has a columnar shape made of synthetic resin, but is not limited to this, and other materials may be used to form any shape as long as it has high insulation and strength that can withstand use.

Figure 4A:
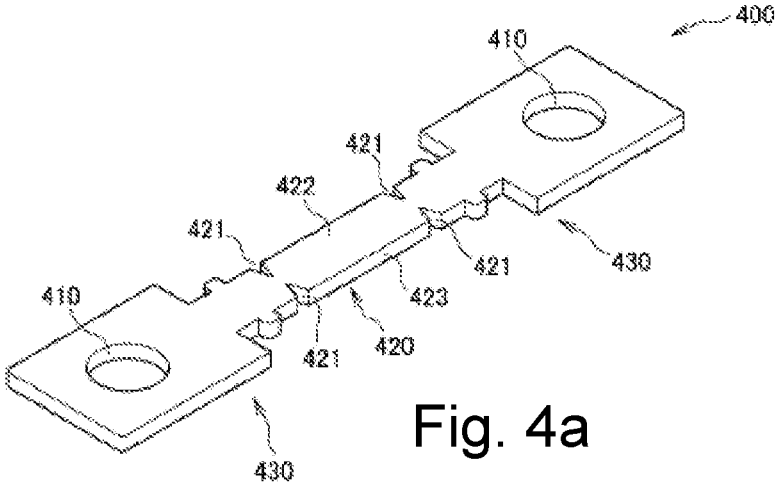
FIG. 4(*a*) is a perspective view of a cut portion of the electric circuit breaker according to the first embodiment of the present disclosure, and FIG. 4(*b*) is a plan view of the cut portion.
Figure 4B:
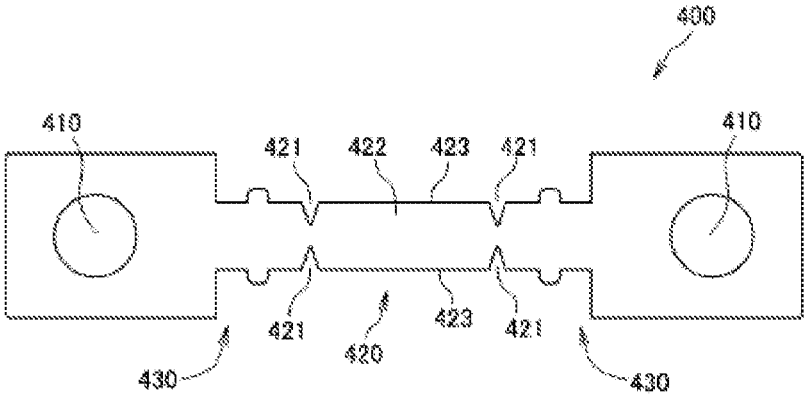

Next, FIG. 4 shows the cut portion 400 that constitutes a part of an electric circuit which is cut off by an electric circuit breaker 600 according to the first embodiment of the present disclosure. FIG. 4(*a*) is a perspective view of the cut portion 400, and FIG. 4(*b*) is a plan view of the cut portion 400. The cut portion 400 is entirely made of a metal conductor in order to electrically connect to an electric circuit, and includes the main body portions 430 for connecting to the electric circuit at both ends, and the separation piece 420 to be cut and separated at substantially the center. Connection holes 410 used for connection to an electric circuit are formed at the end portions of the main body portions 430. Further, notches 421 are formed on both sides of the separation piece 420 so that the separation piece 420 can be easily cut and separated. The abutment surface 512 of the cutting member 511 of the moving body 500 shown in FIG. 3 come into abutment against a surface 422 of the separation piece 420, and the holding surfaces 513 of the cutting member 511 come into abutment against the side surfaces 423 on both sides. As will be described later, when an arc is generated, the main body portion 430 is heated to high temperature and melted, and a metal gas is also generated by the melting.

Figure 5:
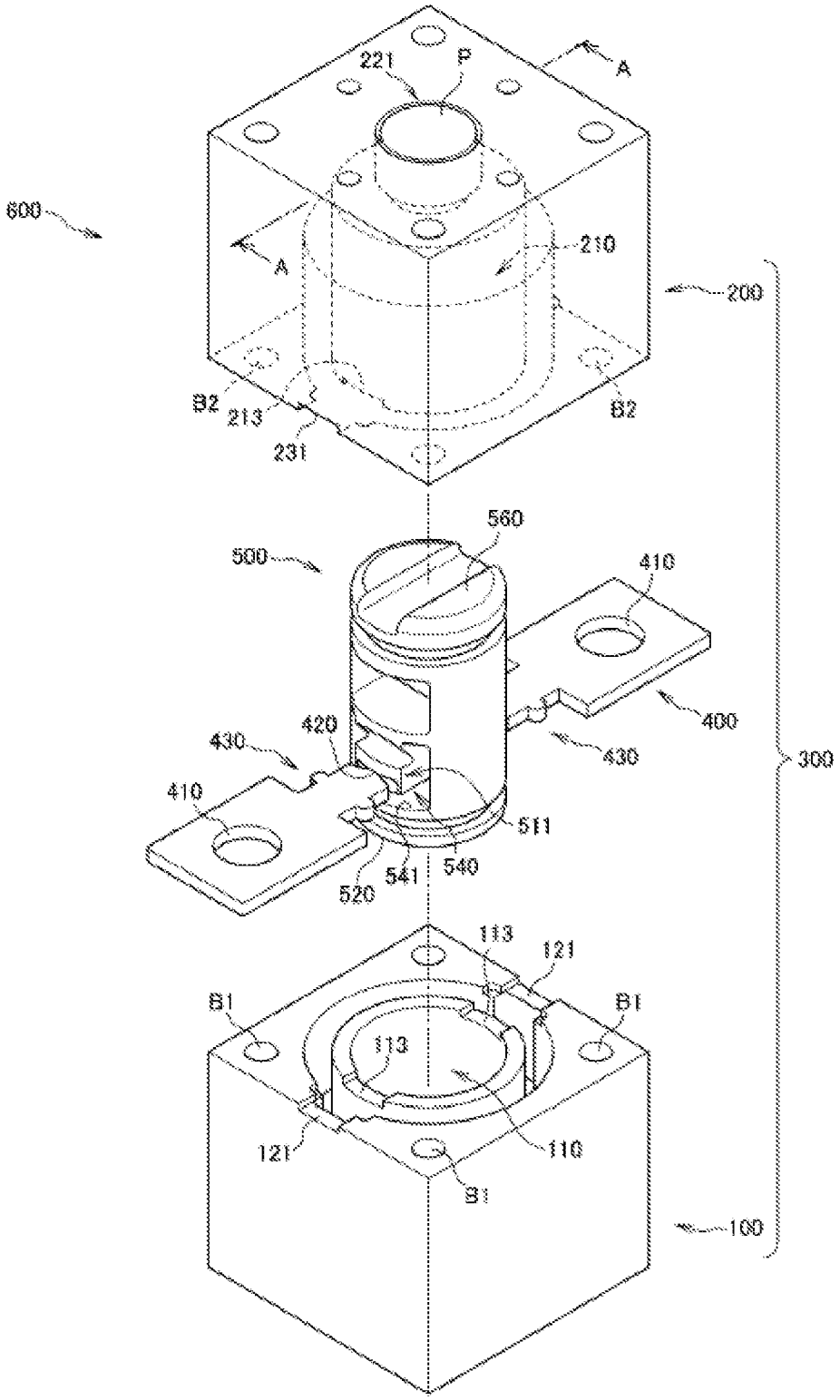
FIG. 5 is an exploded perspective view of the electric circuit breaker according to the first embodiment of the present disclosure.

Next, how to assemble the electric circuit breaker 600 of the present disclosure will be described with reference to FIG. 5. FIG. 5 shows an exploded perspective view of the electric circuit breaker 600.

First, in the penetrating portion 540 of the moving body 500, the main body portions 430 of the cut portion 400 are inserted between the cutting member 511 and the lower wall 541, and the cut portion 400 is inserted up to a position at which the separation piece 420 of the cut portion 400 faces the cutting member 511 of the moving body 500. Then, as shown in FIG. 5, the separation piece 420 of the cut portion 400 is inserted and accommodated inside the moving body 500.

Next, the moving body 500 is inserted from the lower surface 520 side into the lower cylindrical portion 110 of the lower housing 100. Then, the main body portions 430 of the cut portion 400 are placed so as to be fitted into the mounting portions 113 and the mounting portions 121 of the lower housing 100, and the moving body 500 is fixed inside the lower cylindrical portion 110. Next, the upper housing 200 is fitted from above the lower housing 100 so that the upper surface 560 of the moving body 500 is inserted into the upper cylindrical portion 210 of the upper housing 200. Then, by pushing the upper housing 200 toward the lower housing 100, the mounting portions 213 and the mounting portions 231 of the upper housing 200 are fitted to the main body portions 430 of the cut portion 400. The connecting holes B1 and the connecting holes B2 arranged vertically are connected and fixed by a connecting member or the like, so that the housing 300 including the lower housing 100 and the upper housing 200 is assembled under a state of accommodating the cut portion 400 and the moving body 500 therein.

Further, the power source P is mounted to the power source accommodating portion 221 of the upper housing 200. When an abnormality signal is input from the outside when an abnormality of the electric circuit is detected, the power source P explodes, for example, explosive powder inside the power source P, and the air pressure resulting from the explosion causes the moving body 500 to be instantly pushed out inside the cylindrical portion 310 so as to be moved. The power source P is not limited to a power source using explosive powder as long as it generates power to move the moving body 500, and other known power sources may be used.

Figure 6:
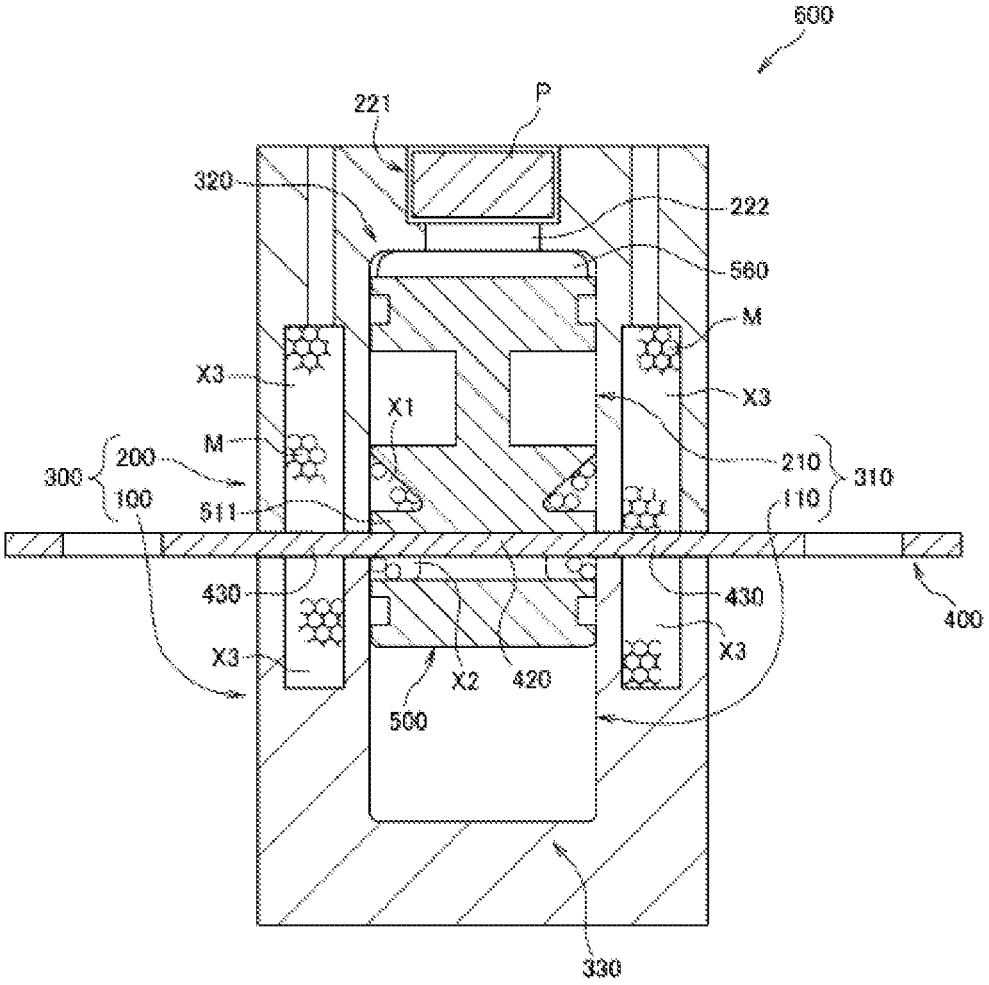
FIG. 6 is a cross-sectional view taken along the line A-A in a state where the electric circuit breaker shown in FIG. 5 is assembled.

Next, the internal structure of the electric circuit breaker 600 according to the first embodiment of the present disclosure will be described with reference to FIG. 6 FIG. 6 is a cross-sectional view taken along the line A-A in a state where the electric circuit breaker 600 shown in FIG. 5 is assembled.

As shown in FIG. 6, the moving body 500 is accommodated inside the cylindrical portion 310 composed of the lower cylindrical portion 110 and the upper cylindrical portion 210 which are linearly arranged. The cylindrical portion 310 extends from a first end portion 320 of the housing 300 to a second end portion 330 on a side opposite to the first end portion 320. Since the moving body 500 is arranged on the first end portion 320 side where the power source P is arranged, the second end portion 330 side of the cylindrical portion 310 is hollow. Therefore, as will be described later, the moving body 500 can move toward the second end portion 330 side while cutting and separating the separation piece 420. In addition, the upper surface 560 of the moving body 500 is adjacent to the power source P mounted inside the power source accommodating portion 221. As will be described later, the air pressure due to the explosion of the explosive powder in the power source P is transmitted to the upper surface 560 of the moving body 500 via the communication hole 222.

Figure 7:
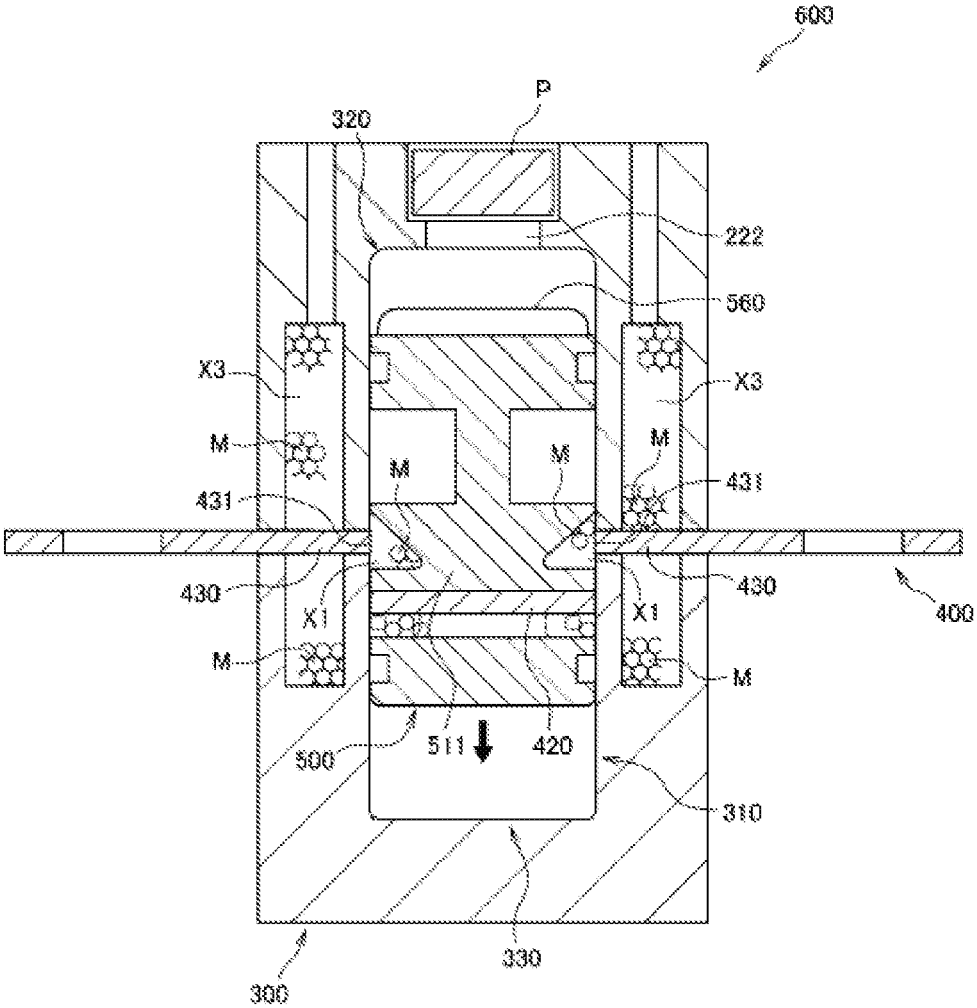
FIG. 7 is a cross-sectional view showing a state where the moving body moves from the state shown in FIG. 6.
Figure 8:
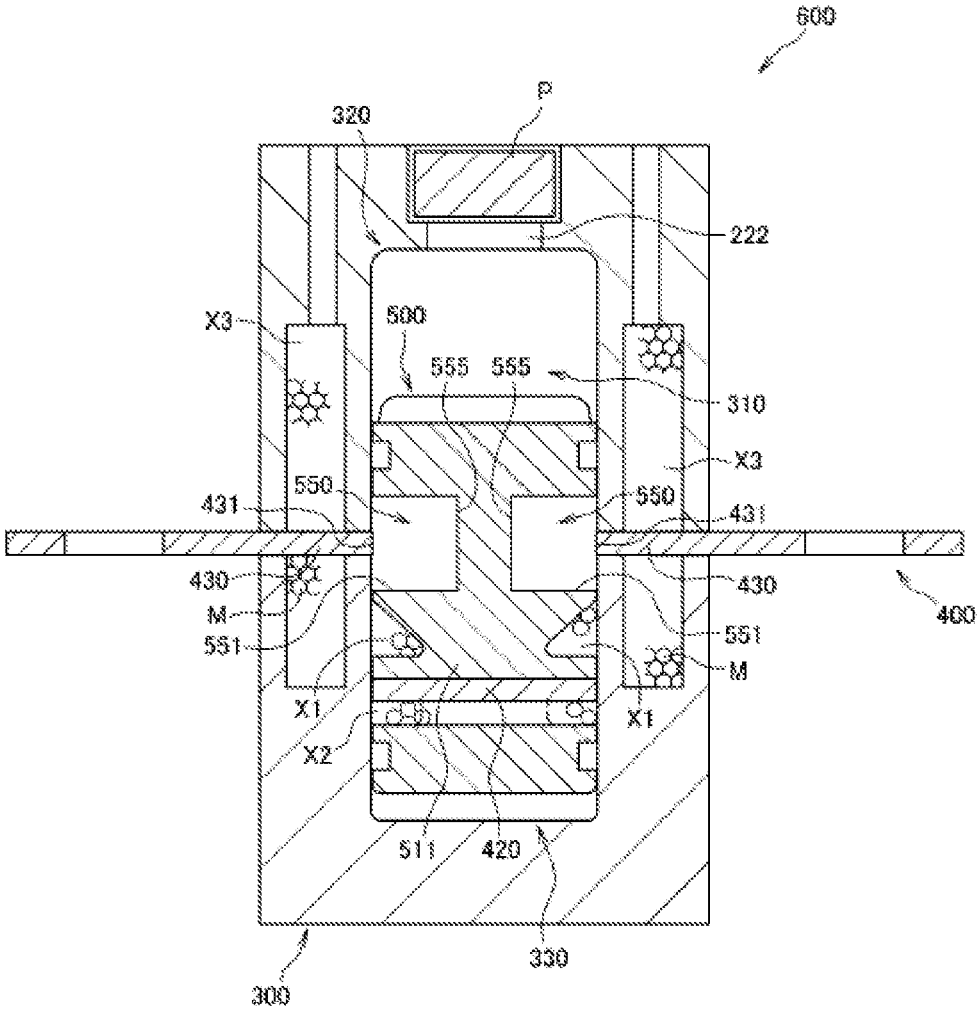
FIG. 8 is a cross-sectional view showing a state where the moving body further moves from the state shown in FIG. 7.

Further, the separation piece 420 of the cut portion 400 is accommodated by being inserted through the inside of the moving body 500, and the main body portions 430 of the cut portion 400 are inserted and accommodated inside the outer arc extinguishing spaces X3. The second arc extinguishing space X2 is arranged on the side opposite to the first arc extinguishing spaces X1 across the cutting member 511. As shown in FIG. 6, a granular arc extinguishing material M is accommodated in the first arc extinguishing spaces X1 and the outer arc extinguishing spaces X3. Moreover, since the arc extinguishing material M is filled in the penetrating portion 540 of the moving body 500, the arc extinguishing material M is also to be accommodated in the second arc extinguishing space X2 and the fourth arc extinguishing spaces X4 (see FIG. 3) of the penetrating portion 540. In FIGS. 6 to 8, although the first arc extinguishing spaces X1, the second arc extinguishing space X2, the outer arc extinguishing spaces X3, and the fourth arc extinguishing spaces X4 are filled with the arc extinguishing material M, only a part of the arc extinguishing material M is shown on the drawing for the sake of visibility.

Although the arc extinguishing material M is accommodated in the first arc extinguishing spaces X1, the present disclosure is not limited to this, and the arc extinguishing material M may not be accommodated. The first arc extinguishing spaces X1 are spaces that are recessed inward, and arcs generated from the end portions 431 of the main body portions 430 are released into the first arc extinguishing spaces X1 as will be described later. Then, the arcs consume energy as they travel through the air in the first arc extinguishing spaces X1, and are eventually extinguished. Therefore, even if the arc extinguishing material M is not accommodated in the first arc extinguishing spaces X1, the first arc extinguishing spaces X1 can sufficiently extinguish the arcs. Similarly, although the arc extinguishing material M is accommodated in the second arc extinguishing space X2 and the fourth arc extinguishing spaces X4, the present disclosure is not limited to this, and the arc extinguishing material M may not be accommodated.

Further, although the arc extinguishing material M is accommodated in the outer arc extinguishing spaces X3, the present disclosure is not limited to this, and the arc extinguishing material M may not be accommodated. As will be described later, the arcs generated from the peripheries of the end portions 431 of the main body portions 430 spread to the surrounding outer arc extinguishing spaces X3. Then, the arcs consume energy as they travel through the air in the outer arc extinguishing spaces X3, and are eventually extinguished. Therefore, even if the arc extinguishing material M is not accommodated in the outer arc extinguishing spaces X3, the outer arc extinguishing spaces X3 can sufficiently extinguish the arcs.

Furthermore, when the arc extinguishing material M is accommodated in the first arc extinguishing spaces X1, the second arc extinguishing space X2, the outer arc extinguishing spaces X3, or the fourth arc extinguishing spaces X4, the arc extinguishing material M is not limited to a granular solid arc extinguishing material such as silica sand, and a gaseous arc extinguishing material that can effectively extinguish an arc such as nitrogen gas may be filled in each space.

Next, a usage mode of the electric circuit breaker 600 according to the first embodiment of the present disclosure will be described with reference to FIG. 7. FIG. 7 is a cross-sectional view showing a state where the moving body 500 moves from the state shown in FIG. 6. As shown in FIG. 7, when an abnormality such as an overcurrent flowing in the electric circuit is detected, an abnormality signal is input to the power source P, and the explosive powder in the power source P explodes. Then, the air pressure due to the explosion is instantaneously transmitted to the upper surface 560 of the moving body 500 via the communication hole 222. Then, due to this air pressure, the moving body 500 is swiftly fused from the first end portion 320 toward the second end portion 330, and instantaneously moves inside the cylindrical portion 310 toward the second end portion 330.

Then, the cutting member 511 of the moving body 500 cuts the separation piece 420 and separate it from the main body portions 430 by the force of pushing out the moving body 500 toward the second end portion 330. Then, the separation piece 420 moves toward the second end portion 330 together with the moving body 500, and separates from the main body portions 430. Further, as shown in FIG. 7, when the moving body 500 moves inside the cylindrical portion 310 toward the second end portion 330, the first arc extinguishing spaces X1 formed above and adjacent to the cutting member 511 move up to the positions facing the main body portions 430. Therefore, the first arc extinguishing spaces X1 are each configured to be located between the separation piece 420 and the main body portion 430 immediately after the cutting member 511 of the moving body 500 cuts the separation piece 420. Then, immediately after the cutting member 511 of the moving body 500 cuts the separation piece 420, since the physical distance between the separation piece 420 and the main body portion 430 is short. Therefore, an arc may be generated between the separation piece 420 and the end portion 431 of the main body portion 430 which is the boundary with the separation piece 420. However, as shown in FIG. 7, the arc generated from the end portion 431 of the main body portion 430 is released to the first arc extinguishing space X1 located between the separation piece 420 and the main body portion 430, and is extinguished. Further, since the arc extinguishing material M is accommodated in the first arc extinguishing space X1, the arc can be extinguished more effectively.

Next, a state where the moving body 500 further moves toward the second end portion 330 will be described with reference to FIG. 8. FIG. 8 is a cross-sectional view showing a state where the moving body 500 further moves from the state shown in FIG. 7. As shown in FIG. 8, when the moving body 500 moves inside the cylindrical portion 310 toward the second end portion 330, the insulating spaces 550 formed above the first arc extinguishing spaces X1 move up to positions facing and adjacent to the main body portions 430. Even if a high voltage is applied between the main body portions 430 on both sides and arcs are generated from the end portions 431 of the main body portions 430, the arcs are confined in the insulating spaces 550. The arcs generated between the main body portions 430 on both sides are confined in the insulating spaces 550 and insulated from each other, so that it is possible to prevent the arcs from connecting between the main body portions 430 on both sides and causing a current to flow in the electric circuit. The description that the arcs are confined in the insulating spaces 550 and insulated from each other specifically refers to a state where the insulating spaces 550 are dents (see FIG. 3) each surrounded by the lower wall 551, the side wall 552, the side wall 553, the upper wall 554, and the rear wall 555, and hence the arc generated from the end portion 431 of the main body portion 430 on one side is blocked from traveling by the insulating space 550 and cannot travel toward the main body portion 430 on an opposite side.

It is desirable that the arc extinguishing material M be not accommodated in the insulating spaces 550. If the arc extinguishing material M is accommodated in the insulating spaces 550, the arc extinguishing material M may be exposed to high temperature and carbonized by the arcs generated from the main body portion 430. Then, the carbonized portion becomes a path through which an electric current can flow, and the arc easily leaks from the insulating space 550. Then, the arc leaking from the insulating space 550 may travel along the outer surface 530 of the moving body 500 and may be connected to the arc generated from the main body portion 430 on the opposite side. Therefore, it is desirable not to accommodate the arc extinguishing material M in the insulating spaces 550. Further, in the insulating spaces 550, instead of the arc extinguishing material M, an insulating material that is not carbonized by an arc may be accommodated.

As described above, according to the electric circuit breaker 600 of the present disclosure, the moving body 500 itself includes the cutting member 511 that cuts the cut portion 400 and the first arc extinguishing spaces X1, and the first arc extinguishing spaces X1 are each configured to be located between the separation piece 420 that is cut and separated and the main body portion 430 that remains in the housing 300 without being separated immediately after the cutting member 511 cuts the separation piece 420 and cut off the electric circuit. Therefore, immediately after the electric circuit is cut off, the arcs generated from the main body portions 430 can be released into the first arc extinguishing spaces X1 and extinguished.

Furthermore, when the arc extinguishing material M is accommodated in the first arc extinguishing spaces X1, the arcs generated from the main body portions 430 can be extinguished more effectively.

Figure 10:
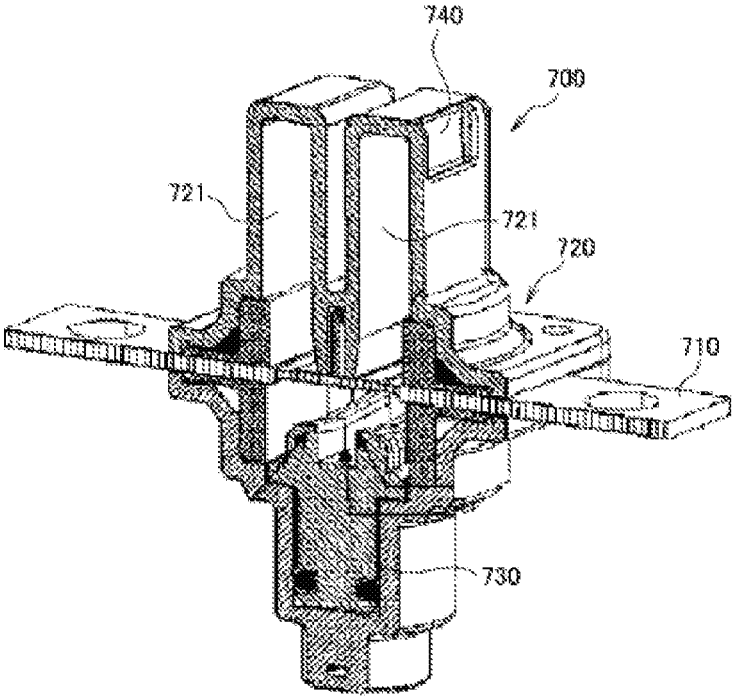
FIG. 10 is a cross-sectional view of a conventional electric circuit breaker.

In the prior art shown in FIG. 10, in order to extinguish an arc, it is also conceivable to enclose a granular solid arc extinguishing material in cutting chambers 721. However, if the arc extinguishing material is enclosed in the cutting chambers 721, it may disturb a punching operation of a punch 730, so that it is difficult to fill the arc extinguishing material in the cutting chambers 721. However, in the present disclosure, unlike the prior art, the arc extinguishing material M can be accommodated in the moving body 500 itself together with the cutting member 511 instead of in the cylindrical portion 310, so that the operation of the moving body 500 that moves inside the cylindrical portion 310 and cuts the separation piece 420 is not disturbed. Further, since the separation piece 420 is accommodated in the moving body 500 and moves together with the moving body 500, there is no risk of disturbing the punching operation of the punch unlike the prior art. Since the arc extinguishing material M and the separation piece 420 are both accommodated in the moving body 500 and move together with the moving body 500, a large amount of the arc extinguishing material M can be accommodated in the moving body 500 unlike the prior art. Furthermore, since the first arc extinguishing spaces X1 can be expanded according to the volume inside the moving body 500, a large amount of the arc extinguishing material M can be accommodated and the arc extinguishing performance is extremely high.

Further, according to the electric circuit breaker 600 of the present disclosure, the insulating spaces 550 are configured to face the main body portions 430 of the cut portion 400 that remain in the housing 300 after the moving body 500 further moves. Thus, even if a high voltage is applied to the main body portions 430 on both sides and arcs are generated from the main body portions 430, the arcs are confined in the insulating spaces 550 and insulated from each other, so that it is possible to prevent the arcs from connecting between the main body portions 430 and causing a current to flow in the electric circuit.

Further, according to the electric circuit breaker 600 of the present disclosure, since the second arc extinguishing space X2 are provided on the side opposite to the first arc extinguishing spaces X1 across the cutting member 511, the arcs traveling from the separation piece 420 toward the second end portion 330 are released into the second arc extinguishing space X2 and extinguished. Furthermore, when the arc extinguishing material M is accommodated in the second arc extinguishing space X2, the arcs can be extinguished more effectively. Further, since the second arc extinguishing space X2 is located on the lower surface side of the separation piece 420, the arc generated in the separation piece 420 is extinguished over a wide range by the arc extinguishing material M in the second arc extinguishing space X2.

Furthermore, according to the electric circuit breaker 600 of the present disclosure, since the main body portions 430 of the cut portion 400 are inserted and accommodated in the outer arc extinguishing spaces X3, the outer arc extinguishing spaces X3 can extinguish the arcs generated from the main body portions 430 toward the periphery.

Specifically, a high voltage may be applied to the main body portions 430 on both sides of the cut portion 400 even after the circuit is cut off, and arcs are generated from the peripheries of the end portions 431 of the main body portions 430 toward the periphery. Then, the main body portions 430 heated to high temperature by the arcs are melted from the end portion 431 sides and release gas to the periphery. However, the arcs generated from the main body portions 430 spread to the surrounding outer arc extinguishing spaces X3, consume energy when traveling in the air in the outer arc extinguishing spaces X3, and are eventually extinguished. Further, since the outer arc extinguishing spaces X3 are close to the main body portions 430 where the arcs are generated, the generated arcs can be extinguished quickly. Therefore, the arcs generated from the main body portions 430 are quickly extinguished in the outer arc extinguishing spaces X3 and do not leak to the outside. Further, the gas generated from the main body portions 430 is dispersed into the surrounding outer arc extinguishing spaces X3, so that the increase in the internal pressure due to the gas can be suppressed, with a result that the electric circuit breaker 600 is prevented from being damaged. In particular, since the internal pressure inside the cylindrical portion 310 is rising due to the explosion of the power source P, if the pressure of the gas generated from the main body portions 430 is further applied, the risk of damage to the cylindrical portion 310 increases. However, the gas generated from the main body portions 430 is dispersed into the surrounding outer arc extinguishing spaces X3, so that the cylindrical portion 310 can be effectively prevented from being damaged.

Furthermore, when the arc extinguishing material M is accommodated in the outer arc extinguishing spaces X3, the arcs can be extinguished more effectively. Further, although the arc extinguishing material M is accommodated in the outer arc extinguishing spaces X3, the present disclosure is not limited to this, and the arc extinguishing material M may not be accommodated. Further, in addition to the arc extinguishing material M, in order to reduce the shock due to the movement of the moving body 500, the shock due to the generation of gas, etc., a shock absorbing material may be accommodated in the outer arc extinguishing spaces X3, and in addition, any material may be accommodated as appropriate according to the application.

The arcs generated from the main body portions 430 can be extinguished by the first arc extinguishing spaces X1, but in the case of enhancing the arc extinguishing performance, it is required to expand the first arc extinguishing spaces X1 to increase the arc extinguishing areas. However, if the first arc extinguishing spaces X1 are expanded, the moving body 500 including the first arc extinguishing spaces X1 and the structure around the cylindrical portion 310 that moves the moving body 500 also become large. However, it is desirable that the drive parts such as the cylindrical portion 310 and the moving body 500 be made as small as possible in view of the performance and safety of the electric circuit breaker 600. Therefore, by providing the outer arc extinguishing spaces X3 that accommodate the main body portions 430 of the cut portion 400 outside the cylindrical portion 310 that moves the moving body 500, the extinguishing performance of the arcs generated from the main body portions 430 is improved without increasing the sizes of the cylindrical portion 310 and the moving body 500.

Since the outer arc extinguishing spaces X3 are arranged above and below the main body portions 430 of the cut portion 400, the arcs generated from the main body portions 430 are released in a wide range and effectively extinguished. However, the outer arc extinguishing spaces X3 are not limited to being arranged above and below the main body portions 430 of the cut portion 400, and may be arranged only on one of the upper side and the lower side of the main body portions 430.

In the first embodiment shown in FIG. 1 to FIG. 8, the insulating spaces 550 are provided at positions above and adjacent to the first arc extinguishing spaces X1, but the present disclosure is not limited to this, and the insulating spaces 550 may not be provided. In that case, the first arc extinguishing spaces X1 are extended to the positions of the insulating spaces 550.

Second Embodiment

Figure 9A:
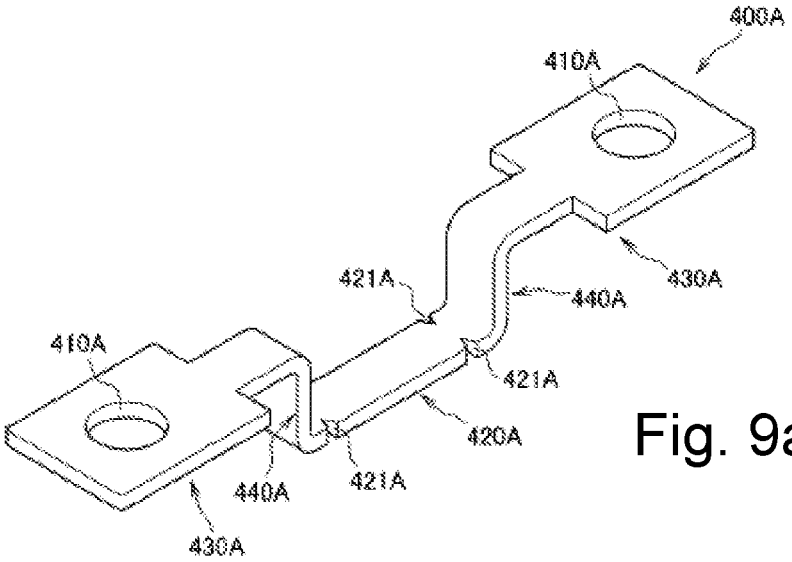
FIG. 9(*a*) is an overall perspective view of a cut portion of an electric circuit breaker according to a second embodiment of the present disclosure, and FIG. 9(*b*) is a cross-sectional view of the electric circuit breaker.
Figure 9B:
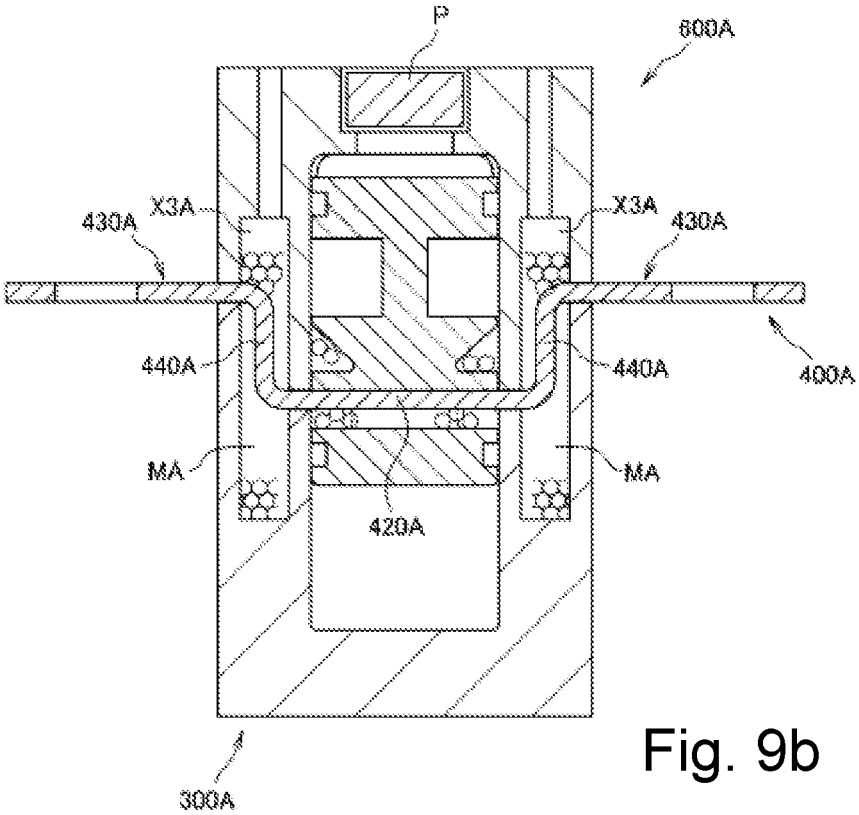

Next, an electric circuit breaker 600A according to a second embodiment of the present disclosure will be described with reference to FIG. 9. FIG. 9(*a*) is an overall perspective view of a cut portion 400A of the electric circuit breaker 600A according to the second embodiment of the present disclosure, and FIG. 9(*b*) is a cross-sectional view of the electric circuit breaker 600A according to the second embodiment in a manner similar to the cross-sectional view of the electric circuit breaker 600 according to the first embodiment shown in FIG. 8. Further, the configuration of the electric circuit breaker 600A according to the second embodiment is basically the same as the configuration of the electric circuit breaker 600 according to the first embodiment, except for the configuration of the cut portion 400A, and hence description of the same configurations will be omitted.

As shown in FIG. 9, the cut portion 400A of the electric circuit breaker 600A includes a separation piece 420A at the center and main body portions 430A on both sides of the separation piece 420A. Further, a part of each of the main body portions 430A is a bent portion 440A that is bent so as to rise from the separation piece 420A. As shown in FIG. 9(*b*), the bent portions 440A of the cut portion 400A are bent in outer arc extinguishing spaces X3A of a housing 300A along the up-down direction in which the outer arc extinguishing spaces X3A extend. Therefore, the length of the main body portions 430A existing in the outer arc extinguishing spaces X3A is longer than the length of the linear main body portions 430 existing in the outer arc extinguishing spaces X3 shown in FIG. 6. As a result, more arcs generated from the main body portions 430A can be released into the outer arc extinguishing spaces X3A, so that the arc extinguishing performance is improved. Furthermore, when the arc extinguishing material M is accommodated in the outer arc extinguishing spaces X3A, the arc extinguishing performance is further improved.

In addition, in FIG. 9, the bent portions 440A of the cut portion 400A have a shape that rises from the separation piece 420A and bends along the up-down direction in which the outer arc extinguishing spaces X3A extend, but the present disclosure is not limited to this. The bent portions 440A may have any shape as long as it bends in the outer arc extinguishing spaces X3A so as to increase the length of the portions existing in the outer arc extinguishing spaces X3A. Further, the electric circuit breaker of the present disclosure is not limited to the above-described examples, various modifications and combinations are possible within the scope described in the claims and the scope of the embodiments, and the these modifications and combinations are included in the scope of right.

According to the present disclosure, there is provided an electric circuit breaker, including a housing, a cut portion that is arranged in the housing and forms a part of an electric circuit, a cutting member that cuts the cut portion, and a power source arranged on a first end portion side of the housing, the electric circuit breaker including a moving body including the cutting member, in which the housing includes a cylindrical portion capable of moving the moving body between the first end portion and a second end portion on a side opposite to the first end portion, in which the moving body is configured such that the cutting member provided in the moving body cuts a separation piece of the cut portion while the moving body moves from the first end portion toward the second end portion by the power source, in which the housing includes an outer arc extinguishing space on an outer side of the cylindrical portion, and in which the outer arc extinguishing space accommodates a main body portion of the cut portion that remains in the housing without being cut when the cutting member cuts the cut portion, while allowing the main body portion to be inserted through an inside of the outer arc extinguishing space.

According to the above feature, since the main body portion of the cut portion is inserted and accommodated in the outer arc extinguishing space, the outer arc extinguishing space extinguishes the arc generated from the main body portion toward the periphery, and the arc is not leaked to the outside. Further, the gas generated from the main body portion is dispersed into the surrounding outer arc extinguishing space, so that the increase in the internal pressure due to the gas can be suppressed, with a result that the electric circuit breaker is prevented from being damaged.

In the electric circuit breaker according to the present disclosure, a part of the main body portion of the cut portion includes a bent portion that is bent in the outer arc extinguishing space.

According to the above feature, more arcs generated from the main body portion can be released into the outer arc extinguishing space, so that the arc extinguishing performance is improved.

In the electric circuit breaker according to the present disclosure, an arc extinguishing material is accommodated in the outer arc extinguishing space.

According to the above feature, the arc can be extinguished more effectively.

As described above, according to the electric circuit breaker of the present disclosure, damage due to increased internal pressure is prevented after the electric circuit is cut off and the arc is prevented from leaking to the outside.

What is claimed is:

1. An electric circuit breaker, including a housing, a cut portion that is arranged in the housing and forms a part of an electric circuit, a cutting member that cuts the cut portion, and a power source arranged on a first end portion side of the housing, the electric circuit breaker comprising a moving body including the cutting member, wherein the housing includes a cylindrical portion capable of moving the moving body between the first end portion and a second end portion on a side opposite to the first end portion, wherein the moving body is configured such that the cutting member provided in the moving body cuts a separation piece of the cut portion while the moving body moves from the first end portion toward the second end portion by the power source, wherein the housing includes an outer arc extinguishing space on an outer side of the cylindrical portion, wherein the outer arc extinguishing space accommodates a main body portion of the cut portion that remains in the housing without being cut when the cutting member cuts the cut portion, while allowing the main body portion to be inserted through an inside of the outer arc extinguishing space; and wherein the outer extinguishing space is configured to extinguish an arc generated inside and prevent an arc from leaking to outside.

2. The electric circuit breaker according to claim 1, wherein a part of the main body portion of the cut portion includes a bent portion that is bent in the outer arc extinguishing space.

3. The electric circuit breaker according to claim 1, wherein an arc extinguishing material is accommodated in the outer arc extinguishing space.

* * * * *